US005620344A

United States Patent [19]

May et al.

[11] Patent Number: 5,620,344

[45] Date of Patent: Apr. 15, 1997

[54] WATER-TIGHT CONTACT PIN PLUG ASSEMBLY

[75] Inventors: Guntram May, Altdorf; Helmut Steinhardt, Nürnberg, both of Germany

[73] Assignee: Framatome Connectors Intl, Paris, France

[21] Appl. No.: 680,112

[22] Filed: Jul. 15, 1996

Related U.S. Application Data

[63] Continuation of Ser. No. 411,282, Mar. 27, 1995.

[30] Foreign Application Priority Data

Mar. 25, 1994 [DE] Germany ..... 44 10 455.3

[51] Int. Cl.[6] ..... H01R 13/405

[52] U.S. Cl. ..... 439/736

[58] Field of Search ..... 439/736, 733, 439/606, 884, 891

[56] References Cited

U.S. PATENT DOCUMENTS

| | | | |
|---|---|---|---|
| 3,897,131 | 7/1975 | Stauffer | 439/733.1 |
| 4,381,134 | 4/1983 | Amselmo et al. | 439/751 |
| 4,480,151 | 10/1984 | Dozier | 439/736 |
| 5,158,479 | 10/1992 | Mouissie | 439/589 |
| 5,310,364 | 5/1994 | Hooper et al. | 439/736 |

FOREIGN PATENT DOCUMENTS

| | | |
|---|---|---|
| 1148613 | 5/1963 | Germany . |
| 2407082 | 9/1974 | Germany . |
| 2725796 | 6/1985 | Germany . |

*Primary Examiner*—Gary F. Paumen
*Assistant Examiner*—T. C. Patel
*Attorney, Agent, or Firm*—Pollock, Vande Sande & Priddy

[57] ABSTRACT

A water-tight contact pin plug assembly in cast plastic parts (1), more particularly plug casings. The contact pins (2) have cross-sectional variations over their cast part length comprising at least two truncated cones (3*a*, 3*b*) which are substantially rotationally symmetrical relatively to the pin axis and the major base surfaces of which form shoulders (5) respectively situated opposite the nearest surface of the plastic part. The distance d between the shoulders (5) and the associated surfaces of the plastic part (1) is large enough to prevent the parts from breaking open in the shoulder zone.

7 Claims, 2 Drawing Sheets

WATER-TIGHT CONTACT PIN PLUG ASSEMBLY

This application is a continuation of U.S. patent application Ser. No. 08/411,282, filed Mar. 27, 1995.

FIELD OF THE INVENTION

This invention relates to a water-tight contact pin plug assembly in cast plastic parts, more particularly plug casings.

BACKGROUND OF THE INVENTION

Plug casings having a plurality of contact pins, known as plug boards, must be of water-tight construction on the plug-in side for numerous applications. The contact pins can be secured in the plug board by being pressed in or by injection molding encapsulation. Various steps are known to assure the required sealing properties of the plug boards on the connection side. In the case of contact pins which have been pressed in it is known to provide a plurality of successive truncated cones all oriented with their apices in the direction of pressing in and providing a relatively tight clamping fit in the plastic casing as a result of the resilience of the plastic material. Nevertheless, reliable water-tightness is not always possible to achieve, since the relatively high forces to which plastic parts are subjected may result in continuous ducts being formed.

Another technique for sealing such plugs involves grouting of the contact pins in the casing. For example, a plug board is known in which the contact pins are fitted with clearance. To seal the contact pins, the plug board is grouted with an UV-hardening two-component silicone. This represents an extremely high manufacturing expense, necessitating separate operations. The two-component silicone requires pre-treatment of the plug board by a primer or plasma etching. The liquid silicone is applied by special metering systems and must be hardened in UV-furnaces. The silicone remains liquid in the shadow of the contact pins, which are bent at an angle in many applications. Even if the silicone is subjected to only slight mechanical load, e.g., on movements of the contact pins, the adhesion is lost so that reliable sealing is again impossible to assure.

SUMMARY OF THE INVENTION

The object of the present invention is to a water-tight contact pin bushing in cast plastic parts, more particularly plug casings, which is very reliable, involves minimum production expenditure, and yet permits contact pin adjustment with minimum tolerances.

The contact pin bushing according to the invention is absolutely water-tight since the cast plastic material completely surrounds the round contour of the base surface of the truncated cone without any hairline ducts forming. No additional operations such as the application of UV-hardening silicone are required, so that a plug board with adjusted contact pins can be taken in finished form from the injection molding tool.

BRIEF DESCRIPTION OF THE DRAWINGS

The invention will now be explained in detail with reference to an exemplary embodiment and the attached drawings wherein.

DETAILED DESCRIPTION

Figure 1:
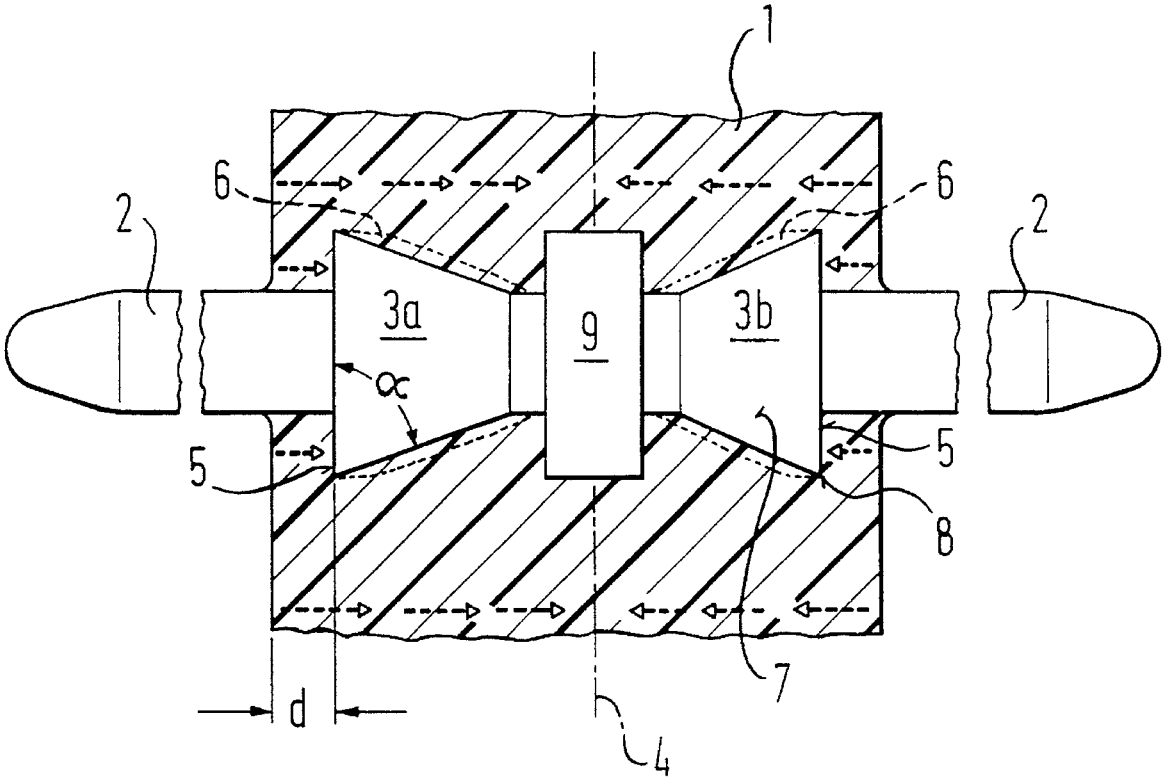
FIG. 1 is a schematic longitudinal section view through a contact pin taken out through a plastic part.

FIG. 1 shows a plastic part 1 e.g., part of a plug board into which the contact pin 2 is molded. The contact pin 2 is taken through the plastic part 1 so as to be water-tight; To this end, two truncated cones 3*a* and 3*b* are disposed on the contact pin inside the plastic part 1. Each of the two truncated cones 3*a* and 3*b* has its major base surface pointing away from the meridian plane 4 of the plastic part 1 and is directed towards that surface of the plastic part which is closest to it. Each truncated cone is fixed to and merges at the opposite end into a cross-section of the contact pin 2. The aperture angle $\alpha$ of the truncated cone, i.e, the angle between the major base of the truncated cone and of the conical surface, is preferably of the order of 70°. The major base of the truncated cone forms a shoulder 5 extending concentrically around the contact pin axis. The shoulder 5 is cast sufficiently deeply in the plastic material for the plastic layer between the shoulder 5 and the corresponding surface of the plastic part in this zone to have a thickness d which is sufficient to prevent the plastic material from tearing open on shrinkage of the plastic during cooling.

This shrinkage, which is represented by the broken-line arrows in FIG. 1, occurs on cooling of the cast plastic. Since this shrinkage takes place to a far greater degree than the shortening of the metal contact pin during cooling, forces occur at the interfaces between the contact pins and the plastic material, and will be considered in greater detail hereinafter. The shrinkage movement is in each case away from the surfaces of the plastic part towards the central region thereof, indicated by the meridian plane 4 in FIG. 1. In other words, a force directed towards the meridian plane 4 acts in each case on the shoulders 5 of the truncated cones 3*a* and 3*b* and ensures that the contact pin is retained without play. Between the planes of the shoulders 5 and the meridian plane 4 the shrinkage tends to lead to the formation of cavitie 6 around the conical surfaces 7 of the truncated cones 3*a* and 3*b*. This effect is not entirely inevitable, although the material shrinkage in the radial direction around the contact pin axis substantially reduces the degree of cavity formation. However, this has no significant effect on the tight fit of the contact pins since it is basically the edge 8 of the shoulder 5 which determines the tight anchoring and sealing properties of the bushing. This edge 8 remains tightly and sealingly enclosed by cast plastic even after shrinkage thereof. The arrangement of the truncated cones according to the invention as described proves superior to other known arrangements and also to simply cylindrical cross-sectional changes. If the truncated cones according to the invention were replaced by cylinders, cavities would form at the shoulders situated towards the meridian plane 4 and could no longer be substantially compensated for by radial shrinkage, so that a far weaker hold would apply for the contact pins axially. If the truncated cones were arranged with their apices each pointing away from the meridian plane, this would also result in large cavities forming inside the plastic part, and the peripheral edge of the shoulders 5, which governs the sealing properties, would be in the immediate vicinity of such cavities. In such cases, it would not be possible to expect the plastic material to be tightly pressed onto the conical surface of the truncated cones, so that there would be no assurance of either a secure fit or absolute water-tightness.

FIGS. 1 shows another cylindrical change of the cross-section of the contact pin 2 in the region of the meridian plane 4. Cylinder 9 is fixed to the contact pin and thus serves further to strengthen the holding of the contact pin. Its arrangement on the meridian plane 4 ensures that no cavities form anywhere, so that it is tightly enclosed on all sides. Thus the tearing-out forces required to release a contact pin from its anchorage are greatly increased. At the same time, its construction and its central position in the molding prevents any accumulation of material.

Figure 2:
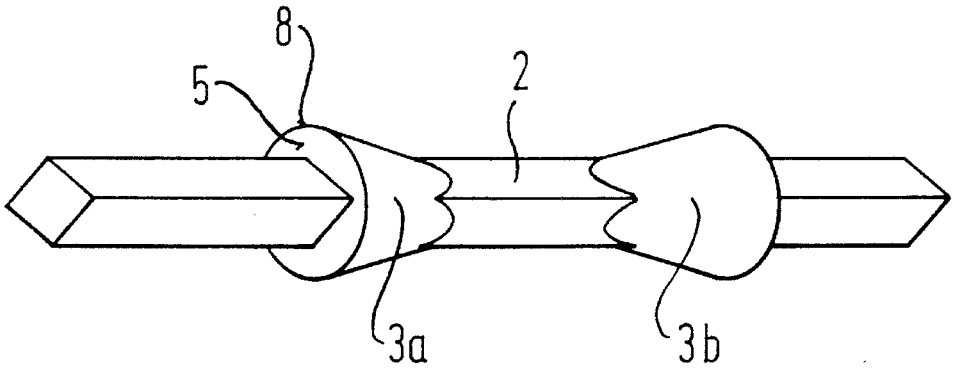
FIG. 2 is a perspective view of a contact pin of rectangular cross-section.

FIG. 2 shows an alternative embodiment of a contact pin in which the waterproof contact pin bushing can be used. This contact pin has a rectangular cross-section. The truncated cones 3*a* and 3*b*, however, are rotationally symmetrical, this being absolutely essential to achieving a water-tight bushing. The circular or, if required, oval shape of the peripheral edge 8 of the shoulder 5 for the first time allows sealing shrinkage of the plastic material on to this edge. Edges which have a contour with corners have hitherto not resulted in a really sealing-tight contact pin bushing. Since only the contour of the peripheral edge 8 is involved, the remaining cross-section of the contact pin may be of any desired shape, more particularly square or rectangular. The peripheral change in the form of truncated cones or cylinders can be obtained by upsetting, hammering or other shaping.

Figure 3:
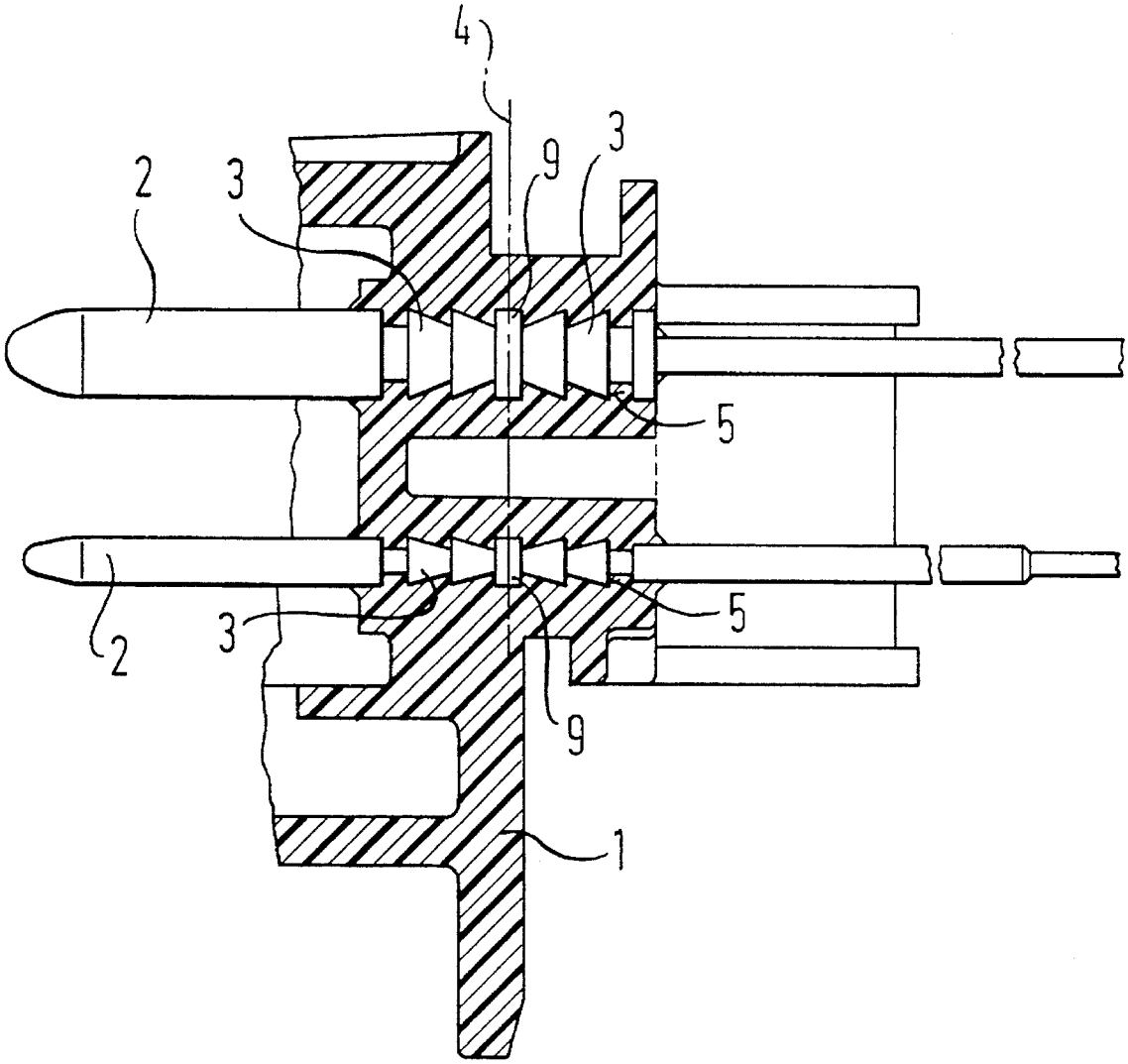
FIG. 3 is a specific example of the use of the water-tight contact pin bushing according to the invention.

FIG. 3 shows a specific example of a water-tight contact pin bushing in a plug board. Like elements in FIGS. 1 and 2 have been given like references in FIG. 3. The plastic part 1 is part of a plug board, contact pins 2 being disposed in two rows parallel to one another. The contact pins 2 in the cast plastic part have cross-sectional changes in the form of truncated cones 3 and a cylinder 9. The truncated cones 3 are each so aligned that their apex points towards the meridian plane 4 of the plastic part and the major base is directed towards the nearest side wall. The cylindrical widening of the cross-section of the contact pin 2 is disposed in the meridian plane 4 between the side surfaces. The top and bottom contact pins 2 in FIG. 3 differ in that their diameters are different on the plug side. In both cases, the diameters of the shoulders 5 and of the cylinder 9 are substantially equal to the diameter of the contact pin on the plug side. In addition to the frusto-conical cross-sectional changes, another cylindrical widening of the cross-section is provided in the case of the top contact pin 2 remote from the plug side, one end face of the widened portion terminating flush with the surface of the plastic part. The material thicknesses between the shoulders 5 and the nearest surfaces of the plastic part are so dimensioned as to reliably prevent any tearing out. The provision of four truncated cones and a cylinder 9 disposed in the meridian plane reliably assures the sealing tightness of the contact pin bushing in the plastic part and provides the highest possible resistance to tearing out.

The plug board shown in FIG. 3 can be produced in one operation in an appropriate injection molding tool, from which the finished end product can be immediately removed. No further processing or additional sealing by UV-hardening silicone is required.

We claim:

1. A water-tight contact pin plug assembly including at least one contact pin cast within plastic parts, said at least one contact pin being completely surrounded by said plastic parts and having cross-sectional variations over a length of a cast part of said at least one contact pin, said cross-sectional variations comprising at least two truncated cones which are substantially rotationally symmetrical relative to an axis of said at least one contact pin and which have major base surfaces forming shoulders situated opposite adjacent surfaces of said plastic part, a distance d between said shoulders and associated surfaces of said plastic part being large enough to prevent said plastic parts from breaking open in a zone of said shoulders.

2. The contact pin plug assembly according to claim 1, wherein said at least two truncated cones each have an angle alpha of about 70° between said major base surfaces and respective surfaces of said cones.

3. The contact pin plug assembly according to claim 1, wherein said at least one contact pin is cylindrical and minor base surfaces of the truncated cones have substantially the same cross-section as said at least one contact pin.

4. The contact pin plug assembly according to claim 1, wherein said at least one contact pin has a polygonal cross-section, and said major base surfaces of said truncated cones have a circular or oval periphery.

5. The contact pin plug assembly according to claim 1, wherein the cross-sectional variations of said at least one contact pin are produced by stamping or upsetting.

6. The contact pin plug assembly according to claim 1, wherein said truncated cones, as well as a cylinder disposed on a meridian plane of said plastic part, are applied to and fixed on said at least one contact pin.

7. The contact pin plug assembly according to claim 1, for use in injection molded PCB plug boards for equipping printed circuit boards.

* * * * *